US006457608B1

(12) United States Patent
Riney

(10) Patent No.: US 6,457,608 B1
(45) Date of Patent: Oct. 1, 2002

(54) LIQUID DISPENSING APPARATUS HAVING INDEPENDENTLY POSITIONABLE LIQUID DISPENSING MODULES

(75) Inventor: John Matthew Riney, Buford, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/977,765

(22) Filed: Oct. 15, 2001

(51) Int. Cl.[7] ..... B67D 5/52

(52) U.S. Cl. ..... 222/135; 222/146.5; 222/330; 239/564

(58) Field of Search ..... 222/135, 146.5, 222/330, 399; 239/562, 563, 564

(56) References Cited

U.S. PATENT DOCUMENTS

| | | | | | |
|---|---|---|---|---|---|
| RE27,865 | E | | 1/1974 | Baker et al. | 222/504 |
| 3,999,691 | A | * | 12/1976 | Doom | 222/330 |
| 4,273,261 | A | * | 6/1981 | Kruger | 222/135 |
| 4,643,335 | A | * | 2/1987 | Carnisio | 222/135 |
| 4,687,137 | A | | 8/1987 | Boger et al. | 239/124 |
| 4,983,109 | A | | 1/1991 | Miller et al. | 425/7 |
| 5,265,800 | A | | 11/1993 | Ziecker et al. | 239/1 |
| 5,620,139 | A | | 4/1997 | Ziecker | 239/124 |
| 5,683,037 | A | | 11/1997 | Rochman et al. | 239/536 |
| 5,740,963 | A | * | 4/1998 | Riney et al. | 239/562 |
| 5,762,098 | A | * | 6/1998 | Manzone et al. | 222/135 |
| 5,829,647 | A | | 11/1998 | Miller | 222/274 |

* cited by examiner

*Primary Examiner*—Joseph A. Kaufman
(74) *Attorney, Agent, or Firm*—Wood, Herron & Evans, L.L.P.

(57) ABSTRACT

A liquid dispensing apparatus that provides for positional adjustment of multiple liquid dispensing modules. The liquid dispensing apparatus includes a flow metering device which provides a flow of a liquid to a plurality of discharge orifices and a spray head attachment comprising a stationary plate, at least one movable plate, and multiple liquid dispensing modules. Flexible liquid supply lines route the liquid from the discharge orifices to the liquid dispensing modules. Each movable plate carries at least one liquid dispensing module and is movable relative to the stationary plate for varying the relative positions of adjacent ones of the liquid dispensing modules. The flexible liquid supply lines conform to the positional adjustment of the movable plates. For dispensing heated liquids, the apparatus may further include a heated enclosure through which the liquid supply lines are routed in the fluid path between the discharge orifices and the liquid dispensing modules.

30 Claims, 6 Drawing Sheets

LIQUID DISPENSING APPARATUS HAVING INDEPENDENTLY POSITIONABLE LIQUID DISPENSING MODULES

FIELD OF THE INVENTION

The present invention generally relates to liquid dispensing apparatus and, more specifically, to liquid dispensing apparatus for dispensing liquids from multiple liquid dispensing modules.

BACKGROUND OF THE INVENTION

Many manufacturing production lines include one or more liquid dispensing systems for dispensing a liquid onto a continuously moving substrate. Typically, the liquid dispensing system includes a flow metering device providing a pressurized, metered flow of the liquid from a source to a distribution manifold and multiple liquid dispensing modules fluidically coupled with the distribution manifold. Among other variables, the pattern in which the liquid is dispensed onto the substrate is determined in large part by the number and spacing of the liquid dispensing modules.

Certain production lines incorporate liquid dispensing operations that apply a pattern of a heated liquid, such as a hot melt adhesive, to a continuously-moving substrate, such as a woven or non-woven web used in the manufacture of multilayer diapers and other multilayer hygienic products. The multiple liquid dispensing modules are arranged in a spaced array so that hot melt adhesive sprayed from any one of the liquid dispensing modules overlaps the sprays from certain adjacent liquid dispensing modules. Typically, the liquid dispensing modules are clustered so that the pattern of hot melt adhesive is distributed over only selected widths of the continuously moving substrate, such as regions of the substrate near its peripheral edges. Occasionally, the hot melt adhesive is sprayed in an uninterrupted pattern extending between the peripheral edges.

The requirement of a distribution manifold adds significant cost to and reduces the versatility of liquid dispensing systems, such as metering gearhead dispensing systems. As mentioned above, liquid is pumped from a flow metering device through the distribution manifold to the array of liquid dispensing modules. The flow metering device typically includes multiple liquid pumps that provide an individualized stream of liquid to each liquid dispensing module in the array. Each of the liquid streams is dedicated to one of the liquid dispensing modules. To route the liquid streams to the array of liquid dispensing modules, a precisely-spaced set of liquid passageways must be machined in the distribution manifold. Each liquid passageway extends from an inlet on the flow metering device side of the distribution manifold to an outlet on the liquid dispensing module side of the distribution manifold. The outlets are precisely arranged with fixed positions in a spaced array that registers with the spaced array of liquid dispensing modules.

The distribution manifold may also be utilized to distribute other fluids to the liquid dispensing modules. Air passageways for pressurized actuation air must be machined in the distribution manifold for the operation of pneumatically-actuated flow metering devices. Process air, often heated, is used to manipulate the sprays of liquid dispensed from the outlets of the liquid passageways. In liquid dispensing systems that dispense heated liquids such as hot melt adhesives, liquid recirculation passageways must be provided in the distribution manifold to recirculate the heated liquid from outlets of liquid passageways that are blocked in a specific dispensing operation to create a particular spray pattern.

To place the outlets at desired locations, bores creating the liquid and air passageways must be machined with precise inclination angles between two sides of the distribution manifold. The pattern of bores is complex and challenging to design without introducing design errors. When the distribution manifold is machined to form the liquid and air passageways, a machining error can irreversibly damage the distribution manifold. Often, the distribution manifold cannot be remachined to correct such errors and must be discarded.

After the liquid passageways are machined in a particular distribution manifold, that distribution manifold is dedicated to one particular dispensing operation. Certain liquid dispensing systems are used in manufacturing processes having production lines in which the dispensing operation can change, such as those production lines capable of fabricating different products having a range of widths. For example, a single production line may be used to produce diapers from substrates of differing widths to accommodate different diaper sizes. To accomplish product changeovers, the liquid dispensing modules must be repositioned to conform the pattern of dispensed liquid to the differing widths. However, the outlets of the liquid passageways in the distribution manifold cannot be relocated for the purpose of repositioning the liquid dispensing modules. Instead, a different distribution manifold with a differing set of liquid passageways must be provided so that the outlets are arranged with spacings appropriate to the particular dispensing pattern. Therefore, many different varieties of distribution manifolds must be stocked to permit the liquid dispensing system to accommodate a corresponding variety of dispensing patterns.

Another problem associated with changes in the dispensing operation of a liquid dispensing system is that the exchange of one type of distribution manifold with a different type of distribution manifold is time consuming and labor intensive. The dispensing operation must be stopped, the liquid dispensing system must be disassembled and the distribution manifolds exchanged, and then the liquid dispensing system must be reassembled and recalibrated before resuming the dispensing operation. During the exchange, the production line containing the dispensing operation is idle. The cumbersome task of replacing the distribution manifold must be repeated each time the dispensing operation changes. Consequently, the down time and expense associated with product changeovers may be significant and recurring.

Liquid dispensing systems have been proposed that attach a plurality of liquid dispensing modules to individual mounting plates in a manner that permits the mounting plates and associated modules to be individually shifted to a plurality of preset locations relative to each other. One such liquid dispensing system having multiple individually-adjustable liquid dispensing modules is described in U.S. Pat. Nos. 5,683,037 and 5,265,800, both commonly owned by the assignee of the present invention. While these patents disclose effective liquid dispensing systems, a principle disadvantage of such systems is that the fluid connections between the movable plates and a distribution manifold of a flow metering device rely upon oval-shaped polymeric O-rings that seal oval-shaped discharge ports in the manifold. Over time, repeated movements of the movable plates deteriorate the condition of the polymeric O-rings, which are susceptible to wear and to twisting within their respective glands. As a result, the o-rings lose their ability to provide an effective fluid seal. When sealing effectiveness is lost so that leakage occurs, the liquid dispensing operation must be suspended to replace the damaged O-ring.

What is needed, therefore, is a liquid dispensing system having multiple liquid dispensing modules that permits the spacing between adjacent modules to be rapidly adjusted without exchanging one distribution manifold for a different distribution manifold and, for heated liquids, a system that can maintain the liquid at a desired temperature while allowing for the positional adjustment.

SUMMARY OF INVENTION

The present invention provides an apparatus having multiple liquid dispensing modules for dispensing a liquid, including ambient-temperature liquids and heated liquids, that permits the positions of one or more liquid dispensing modules to be spatially adjusted relative to the positions of adjacent ones of the liquid dispensing modules for altering the pattern of dispensed liquid. In accordance with the principles of the present invention, the apparatus includes a flow metering device having a liquid discharge port operable to discharge metered quantities of a liquid, a stationary plate mounted to the flow metering device, a movable plate mounted for sliding movement relative to the stationary plate, and a liquid dispensing module attached to the movable plate. The stationary plate has a first throughbore extending therethrough and the movable plate includes a liquid passageway with an inlet and an outlet. A liquid dispensing module is fluidically coupled with the outlet of the liquid passageway. The apparatus further includes a liquid supply line having a first end fluidically coupled with the liquid discharge port and a second end extending through the first throughbore in the stationary plate to fluidically couple with the inlet of the liquid passageway. The liquid supply line includes a flexible first portion that permits the liquid discharge port and the inlet of the liquid passageway to remain fluidically coupled when the movable plate is slidingly moved relative to the stationary plate.

In certain embodiments, the apparatus is provided with a heated enclosure that creates a heated space between the liquid discharge port of the flow metering device and the first throughbore of the stationary plate. The heated enclosure includes a first aperture registered with the first throughbore. The heated enclosure is particularly useful for dispensing heated liquids in which the liquid inside each of the plurality of liquid supply lines is maintained in a heated state for dispensing.

In other embodiments, the apparatus includes a flow metering device having a liquid discharge port operable to discharge metered quantities of a liquid, a stationary plate mounted to the flow metering device, a plurality of movable plates each mounted for sliding movement relative to the stationary plate, and a plurality of liquid dispensing modules each attached to one of the movable plates. The stationary plate has a plurality of first throughbores extending therethrough and each movable plate includes at least one liquid passageway with an inlet and an outlet. Each liquid dispensing module is fluidically coupled with the outlet of one of the liquid passageways. The apparatus further includes a plurality of liquid supply lines each having a first end fluidically coupled with one of the liquid discharge ports and a second end extending through one of the first throughbores in the stationary plate to fluidically couple with the inlet of one of the liquid passageways. Each liquid supply line includes having a flexible first portion that permits the liquid discharge ports and the inlet of the interconnected liquid passageway to remain fluidically coupled when respective ones of the movable plates are slidingly moved relative to the stationary plate. The apparatus may be provided with a heated enclosure that creates a heated space between the plurality of liquid discharge ports and the plurality of first throughbores in the stationary plate. The heated enclosure includes a plurality of first apertures each registered with one of the plurality of first throughbores. The heated enclosure is particularly useful for dispensing heated liquids in which the liquid inside each of the plurality of liquid supply lines is maintained in a heated state for dispensing.

Various additional advantages and features of the invention will become more readily apparent to those of ordinary skill in the art upon review of the following detailed description taken in conjunction with the accompanying drawings.

DETAILED DESCRIPTION

Figure 1:
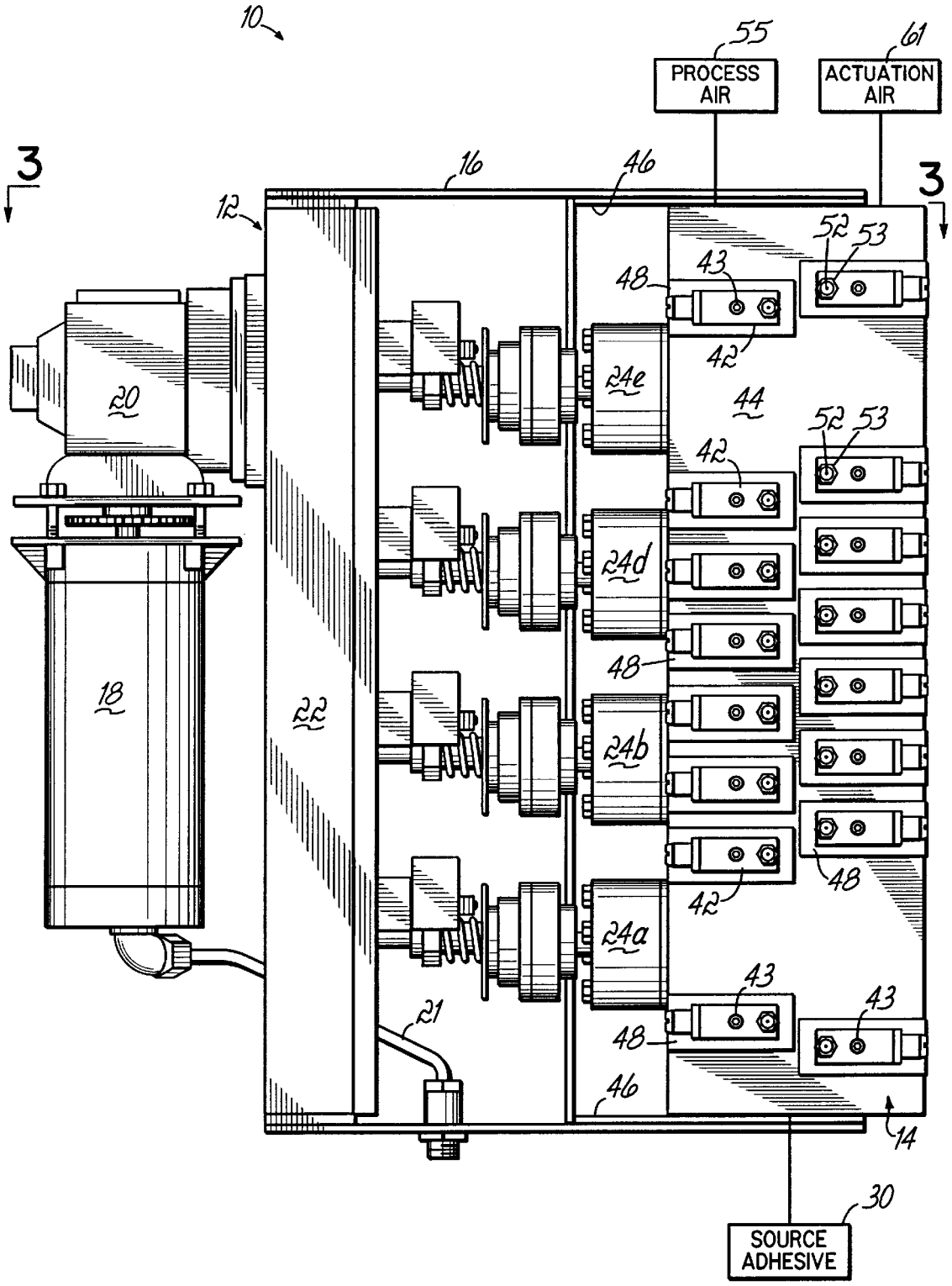
FIG. 1 is a bottom elevational view of one embodiment of the hot melt adhesive dispensing system of the present invention

The present invention relates to apparatus for applying a pattern of a liquid, including cold liquids such as glues and heated liquids such as hot melt adhesives, on a continuously moving substrate, such as a woven or nonwoven web. The apparatus of the present invention are particularly useful for spraying liquids to adhesively bond a diverse layer to a continuously-moving substrate as part of a process to form a disposable absorbent article, such as a disposable diaper, an adult incontinence product, a feminine care product, a training pant, or the like. The apparatus of the present invention expedite product changeovers which require changes in the pattern of the dispensed liquid such that downtime and concomitant expense is significantly reduced compared with similar product changeovers performed in conventional liquid dispensing systems.

The present invention can be used to spray liquid in any desired pattern on a substrate, such as a continuous moving substrate. As used herein, the term "spray" and variations thereof refers to the flow of adhesive which results when the adhesive is dispensed from a flow control device such as a nozzle, an orifice or the like. As used herein, the term "pattern" refers to any geometric or non-geometric configuration which can include, among others, a series of connected or unconnected lines or curves, a series of parallel or non-parallel or intersecting lines or curves, a series of linear or curvilinear lines, a random array of discontinuous lines or droplets, or any combination thereof. The pattern may include intermittent, repeating or non-repeating sub-patterns that are either spaced-apart or contiguous.

It is understood that any desired liquid, such as cold liquids or heated liquids, may be dispensed in accordance with the present invention. However, for the sake of simplicity, the present invention will be described more specifically in connection with dispensing hot melt adhesives. Hereinafter, the present invention will be described with reference to one of many possible embodiments of liquid dispensing apparatus within the spirit and scope of this invention.

With reference to FIGS. 1, 1A, 2, 3 and 3A, one embodiment of a hot melt adhesive dispensing system 10 of the present invention includes a flow metering device, such as a metering gear head 12, and a spray head attachment 14 mounted to the metering gear head 12. A housing 16 of the metering gear head 12 carries an electric motor 18 which has an output drivingly connected to an input of a gear reducer 20. The electric motor 18 is powered by a conventional power source (not shown) via a power cable 21. An output of the gear reducer 20 is operatively connected to a transmission 22 which extends between the opposed side walls of housing 16. The transmission 22 is drivingly connected to a plurality of, for example, four gear pumps 24*a–d* which are located within the housing 16. The gear pumps 24*a–d* are mounted to a manifold 26 carried by a portion of the housing 16. The manifold 26 further includes an inlet 28 connected to an adhesive source 30 and internal pump supply passageways (not shown) that route respective flows of a hot melt adhesive to each of the gear pumps 24*a–d*. The manifold 26 further includes cartridge heaters 32 for elevating the temperature of the manifold 26 and a temperature sensor 34, such as a resistance temperature detector or a thermocouple. The temperature sensor 34 provides a feedback signal of temperature-sensing information, representing the temperature of the manifold 26, to a temperature controller (not shown) powering the cartridge heaters 32.

Figure 1A:
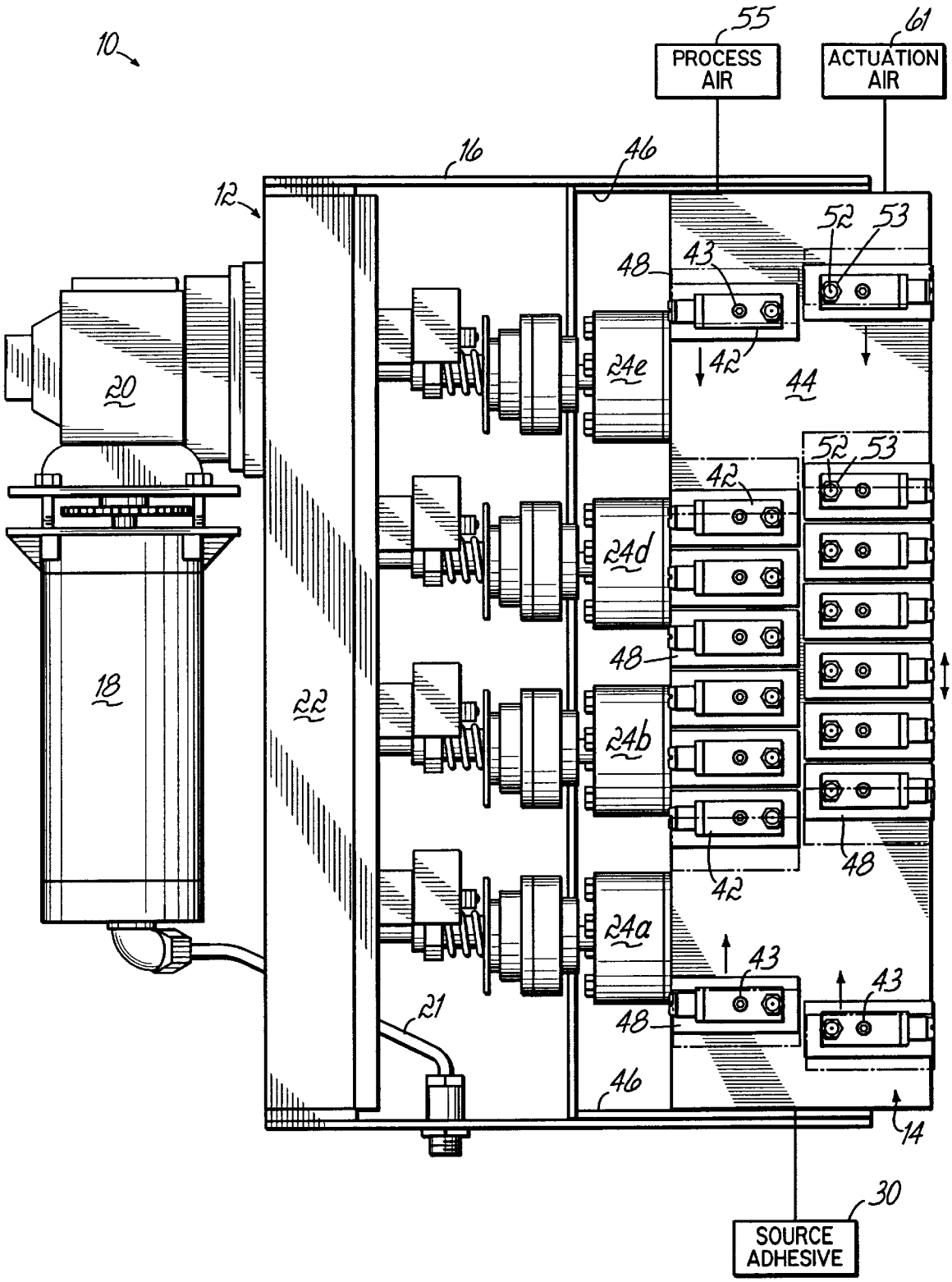
FIG. 1A is a bottom elevational view of the hot melt adhesive dispensing system of FIG. 1 illustrated with the liquid dispensing modules altered to a different spray pattern.
Figures 2, 5:
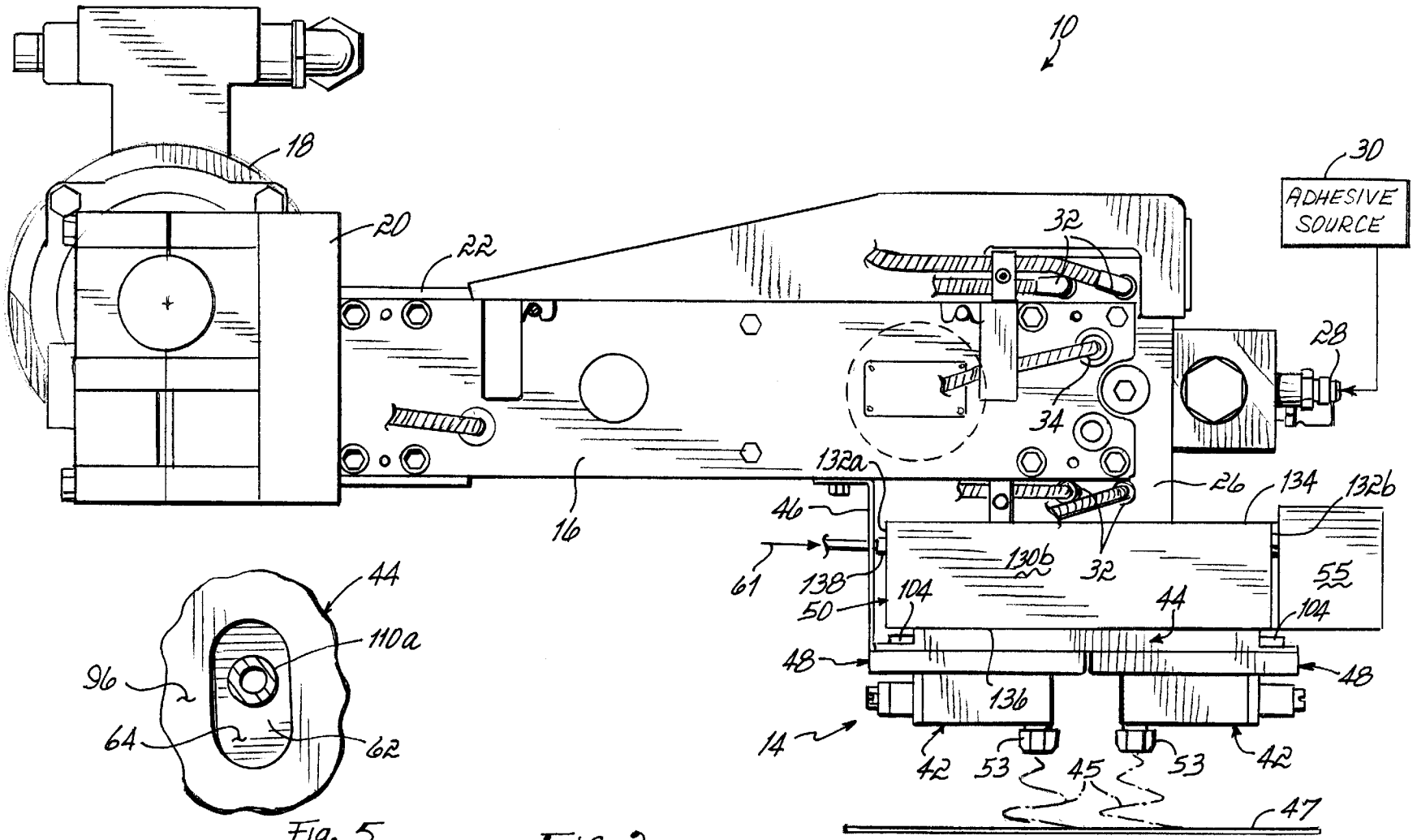
FIG. 2 is a side elevational view of the hot melt adhesive dispensing system of FIG. 1.
FIG. 5 is a fragmentary top view depicting one of the throughbores in the stationary plate.
Figure 3:
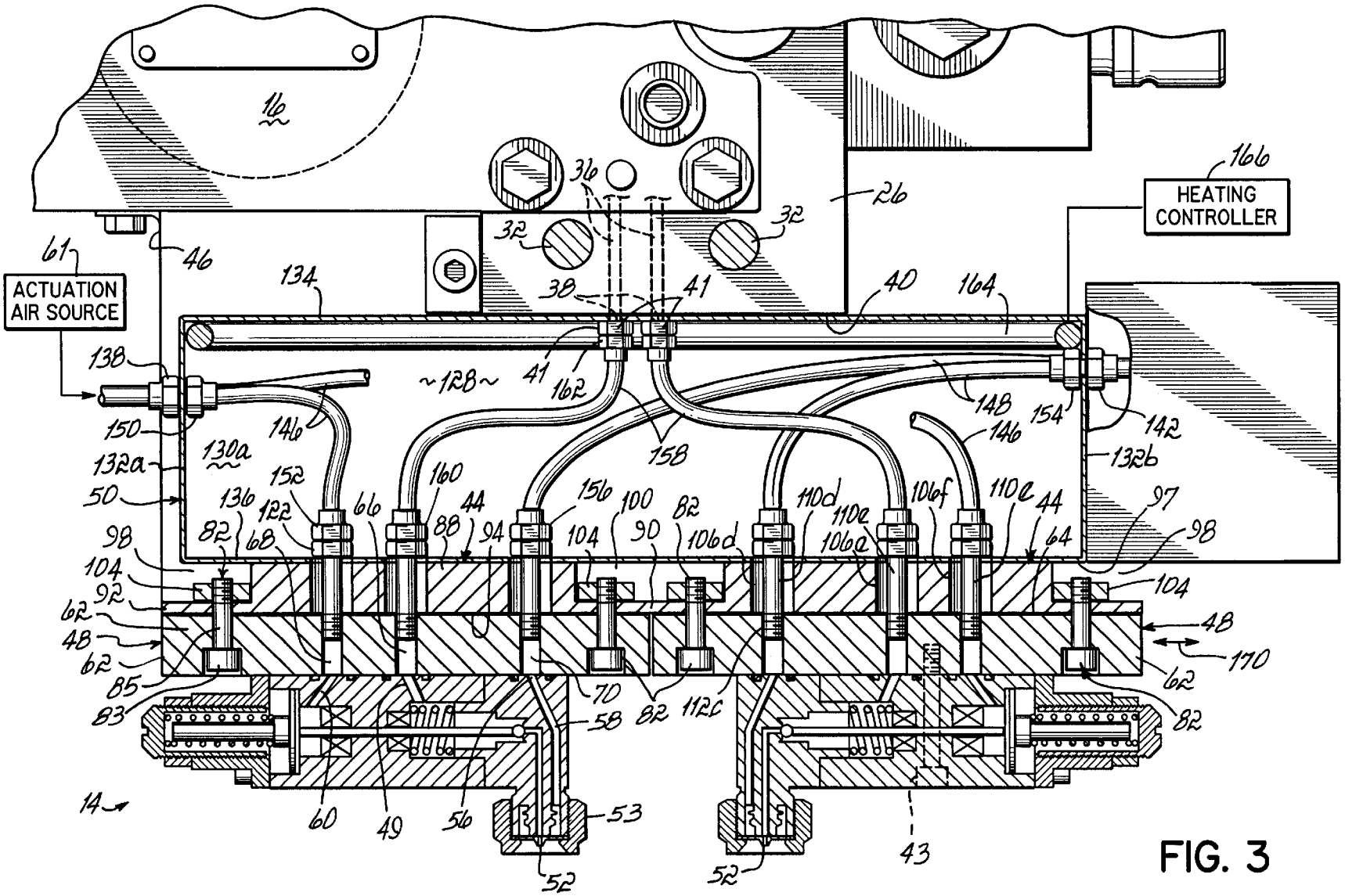
FIG. 3 is a cross-sectional view taken generally along line 3—3 of FIG. 1.

With continued reference to FIGS. 1, 1A, 2, 3 and 3A, the output of each gear pump, for example, gear pump 24*d* is fluidically coupled with a plurality of, for example, four individual, non-intersecting adhesive supply passageways 36, only two of which are shown in FIG. 3. Each adhesive supply passageway 36 extends through the manifold 26 to a dedicated discharge outlet 38 formed on an outer face 40 of manifold 26. A fitting 41 is installed in each discharge outlet 38. Gear pump 24*d* is operable to displace or pump a metered stream of a hot melt adhesive from the adhesive source 30 into each of the adhesive supply passageways 36. Each of the other gear pumps 24*a–c* displaces or supplies a stream of hot melt adhesive to each of four individual, non-intersecting adhesive supply passageways, not shown but similar to supply passageways 36, so that a total of sixteen adhesive supply passageways 36 extend through the manifold 26 and a total of sixteen discharge outlets 38 are provided on outer face 40. Each discharge outlet 38 is available to provide an individual stream of hot melt adhesive to a liquid dispensing module 42.

As best shown in FIGS. 1 and 1A, the spray head attachment 14 includes a bank of, for example, sixteen liquid dispensing modules 42, a pair of stationary plates 44 attached with a pair of brackets 46 to the housing 16 of the metering gear head 12, a plurality of, for example, sixteen movable plates 48, and a heated enclosure 50 disposed between the manifold 26 and the stationary plates 44. Each of the movable plates 48 carries one of the liquid dispensing modules 42 and the movable plates 48 are independently movable relative to others of the movable plates 48 and to the stationary plates 44. The liquid dispensing modules 42 are mounted to the movable plates 48 by mounting bolts 43 (FIG. 1). The movable plates 48 are movable relative to the stationary plate 44 for varying the locations of the respective attached ones of the dispensing modules 42 and, thereby, for varying the spray pattern of the hot melt adhesive dispensed by the bank of liquid dispensing modules 42, as will also be described below. Stationary plate 44 and movable plates 48 may be constructed of any structurally rigid material, such as a stainless steel, that is thermally conductive.

The bank of liquid dispensing modules 42 may include any number of dispensing modules 42 arranged to provide the desired pattern of hot melt adhesive on a moving substrate 47 (FIG. 2). For example, as representatively illustrated in FIGS. 1 and 1A, the liquid dispensing modules 42 may be arranged in an array with spacings such that a spray 45 of hot melt adhesive from each liquid dispensing module 42 overlaps the spray 45 (FIG. 2) from adjacent ones of the liquid dispensing modules 42. The liquid dispensing modules 42 may be any flow control device adapted to accept a flow of hot melt adhesive and dispense the adhesive therefrom in a controlled manner. Typically, the dispensing modules 42 are configured to be actuated between an open position, in which hot melt adhesive is dispensed (as shown in FIG. 2), and a closed position, in which the flow of adhesive is discontinued. Suitable dispensing modules 42 include pneumatic liquid dispensing modules, electric liquid dispensing guns, nozzles, and like devices. Although the liquid dispensing modules 42 will be discussed hereinafter as having the form of pneumatic dispensing modules 42, it is understood that the present invention is not so limited.

Figure 3A:
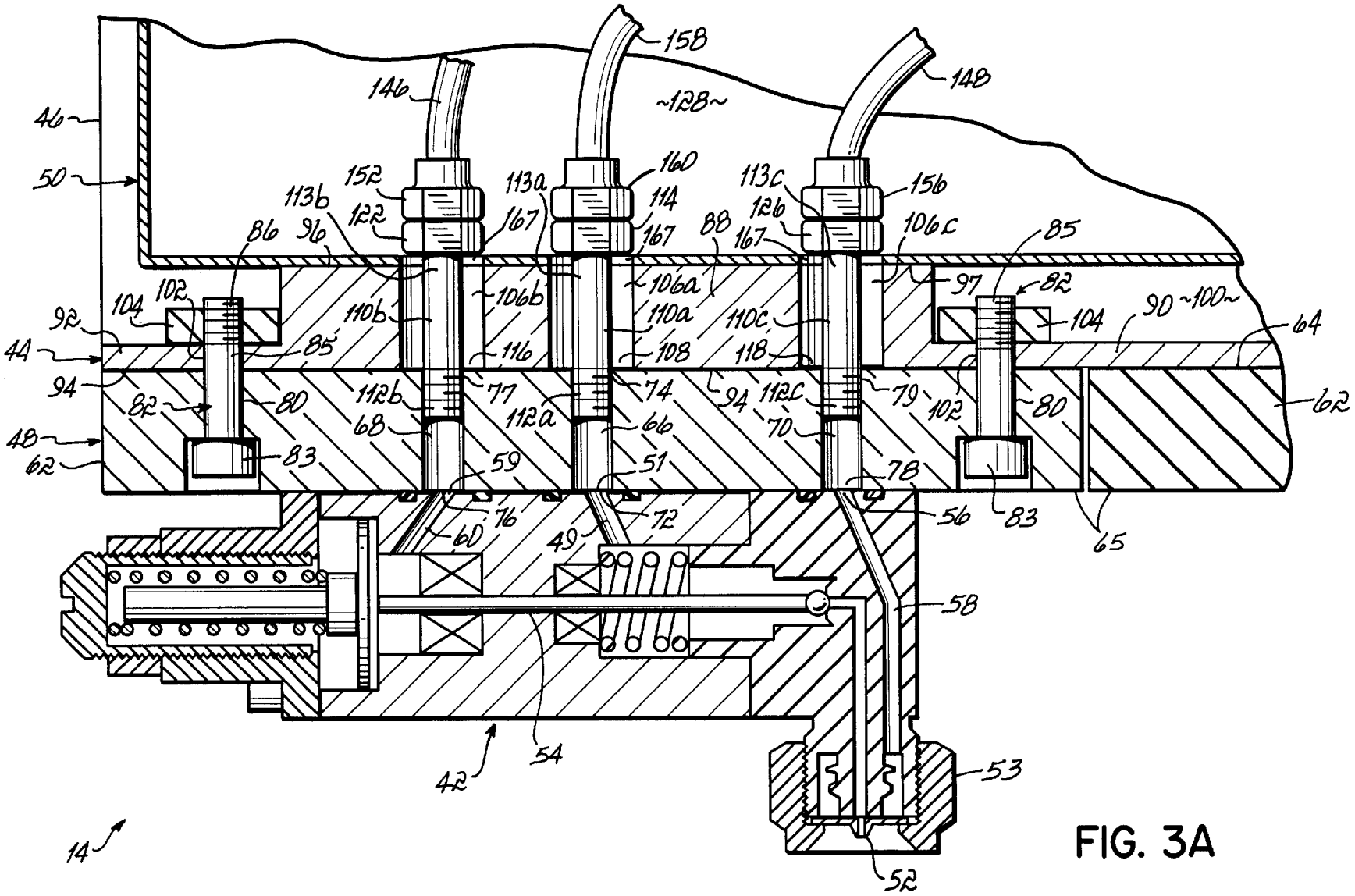
FIG. 3A is an enlargement of a portion of FIG. 3.

With reference to FIGS. 3 and 3A, each liquid dispensing module 42 includes an adhesive passageway 49 extending between an adhesive inlet 51 and a dispensing outlet 52 in a nozzle 53. The liquid dispensing module 42 includes a pneumatically-actuated valve element 54 that controls the flow of hot melt adhesive from the adhesive inlet 51 to the dispensing outlet 52. Each liquid dispensing module 42 further includes an actuation air inlet 59 at the entrance to an actuation air passageway 60. Pressurized actuation air is supplied through each actuation air passageway 60 to actuate the pneumatically-actuated valve element 54 in a conventional manner between open and closed positions for controlling the flow of the hot melt adhesive through liquid dispensing module 42. The liquid dispensing module 42 has other elements, such as a spring return, an air piston connected to valve element 54, a valve plug and a valve seat, that are familiar to persons of ordinary skill in the art and that cooperate with the valve element 54 to regulate the flow of hot melt adhesive in a conventional manner. The actuation air is selectively provided from an actuation air source 61 at an air pressure, typically ranging from about 40 pounds per square inch (p.s.i.) to about 60 p.s.i., effective to actuate the valve element 54 of the liquid dispensing module 42.

The flow of actuation air to each liquid dispensing module 42 can be regulated to provide high-speed intermittent or continuous adhesive placement on substrate 47 (FIG. 2). To that end, individual liquid dispensing modules 42 may be independently actuated by, for example, dedicated solenoids (not shown) regulating the application of actuation air from actuation air source 61 or groups of the modules 42 may be collectively actuated by the common application of actuation air from actuation air source 61 regulated by, for example, a shared solenoid. The liquid dispensing system 10 may be provided with a programmable control system configured to send control signals to the solenoids which, in response thereto, initiate adhesive sprays at the proper times to provide the desired pattern of adhesive on the continuously-moving substrate 47 (FIG. 2).

Each liquid dispensing module 42 further includes a process air inlet 56 at the entrance to a process air passageway 58 that terminates adjacent to the dispensing outlet 52. The process air, typically heated to a temperature from about 25° F. to about 35° F. hotter than the temperature of the hot melt adhesive, is supplied from a process air source 55 at a pressure of about 10 p.s.i. to about 30 p.s.i., is utilized to attenuate or stretch the dispensed stream of hot melt adhesive to create elongated strands or fibers. The process air may also be utilized to swirl or rotate the adhesive fibers as they are dispensed, as illustrated in FIG. 2.

With continued reference to FIGS. 3 and 3A, each movable plate 48 comprises a generally rectangular block 62 of a thermally conductive material, such as a metal or, more specifically, a stainless steel. Extending through the thickness of each of each movable plate 48 from a top surface 64 to the bottom surface 65 is at least one adhesive passageway 66, at least one actuation air passageway 68, and at least one process air passageway 70 that collectively supply fluids to the ones of the liquid dispensing module 42 attached to that movable plate 48. Each movable plate 48 supports one or more liquid dispensing modules 42 and will incorporate one of the adhesive passageways 66, one of the actuation air passageways 68, and one of the process air passageways 70 for each liquid dispensing module 42.

With reference to FIG. 3A, each adhesive passageway 66 includes an adhesive outlet 72 fluidically connected with the adhesive inlet 51 of the liquid dispensing module 42 and an adhesive inlet 74 opposite the outlet 72. Each actuation air passageway 68 includes an actuation air outlet 76 fluidically connected with the actuation air inlet 59 of the liquid dispensing module 42 and an actuation air inlet 77 opposite the outlet 76. Each process air passageway 70 includes a process air outlet 78 fluidically connected with the process air inlet 56 of the liquid dispensing module 42 and a process air inlet 79 opposite the outlet 78. In the embodiment illustrated in FIG. 3A, each passageway 66, 68, and 70 has an internally threaded length proximate the respective inlet 74, 77, 79 thereof. Seals, such as O-rings in grooves, are disposed about the outlets 72, 76, and 78 to insure that hot melt adhesive, process air and actuation air do not leak between the bottom surface 65 and the body of the liquid dispensing module 42.

With continued reference to FIG. 3A, transversely-spaced fastener throughbores 80 are provided near each of an inner edge and an outer edge of each movable plate 48. Each fastener throughbore 80 is configured and dimensioned to removably receive a threaded fastener 82 such that a head 83 of the fastener 82 is accepted in a countersunk portion of the throughbore 80 and such that the shank 85 of the fastener extends axially through the throughbore 80. An end of the shank 85 of each fastener 82 includes a threaded portion and projects above the top surface of the movable plate 48.

With reference to FIGS. 3 and 3A, each of the stationary plates 44 includes a longitudinal center section 88 flanked by an integral inner longitudinal flange 90 and an integral outer longitudinal flange 92. Each stationary plate 44 is formed of a thermally conductive material, such as a metal or, more specifically, a stainless steel. The inner and outer longitudinal flanges 90, 92 extend outwardly in opposite directions from opposite longitudinal side edges of the center section 88. The top surface 64 of each movable plate 48 has a generally abutting and confronting surface-to-surface relationship with a bottom surface 94 of each stationary plate 44. A top surface 96 of each center section 88 has a generally abutting surface-to-surface relationship with a bottom surface 97 of the heated enclosure 50. Each of the outer flanges 90 has a vertically spaced relationship relative to the heated enclosure 50 so that a longitudinal gap 98 is provided along each of the longitudinal edges of the stationary plate 44 between each outer flange 90 and the heated enclosure 50. The inner flanges 89 of the two stationary plates 44 have an edge-to-edge abutting relationship such that a longitudinal cavity 100 of a rectangular cross-sectional profile is provided relative to the bottom surface 97 of the heated enclosure 50.

Each of the movable plates 48 has a fastened state which fixes the position of each movable plate 48 relative to the stationary plate 44 and an unfastened state in which the movable plate 48 is free to move relative to the stationary plate 44 over a limited range of motion. To that end, each stationary plate 44 includes two sets of, for example, sixteen throughbores 102, of which two throughbores 102 are shown in FIG. 3 for each of the pair of stationary plates 44, having a spaced relationship along the longitudinal axis of each plate 44. Transversely-spaced pairs of throughbores 102 are provided for each movable plate 48. Each throughbore 102 is oversized in at least one dimension relative to the dimensions of the shank 85 of the corresponding one of the fasteners 82, as will be described below.

With reference to FIGS. 3 and 3A, a fastening device 104, of which four fastening devices 104 are shown in FIG. 3, is provided for each of the threaded fasteners 82 and participates in providing the fastened and the unfastened states of the movable plates 48. The fastening device 104 may have the form, as best illustrated in FIG. 3A, of a nut shaped with a number of flat surfaces on the outer periphery and internal threads on an axially-extending cylindrical inner bore. The internal threads of the fastening device 104 are configured and dimensioned to threadingly mate with the threaded portion 86 of the fastener 82. A portion of the outer periphery of each fastening device 104 engages one of a pair of side surfaces of the center section 88 so as to inhibit or eliminate rotation relative to the fastener 82 when the corresponding fastener 82 is advanced or withdrawn. The movable plate 48 is released from a fastened state by untightening or loosening the associated ones of the fasteners 82 relative to the respective fastening device 104 so that the movable plate 48 is no longer captured between the respective heads 83 of the fasteners 82 and the bottom surface 94 of the stationary plate 44. The fastening devices 104 and/or fasteners 82 may assume differing conventional forms without departing from the spirit and scope of the present invention.

With continued reference to FIGS. 3 and 3A, extending through the thickness of each stationary plate 44 from the top surface 96 to the bottom surface 94 are a plurality of throughbores 106*a–f* arranged in sets of three, of which only a first set consisting of throughbores 106*a–c* is shown in FIG. 3A. A second set consisting of throughbores 106*d–f* is shown in FIG. 3. The set of throughbores 106*a–c* is identical to the set of throughbores 106*d–f* and the remaining sets of three throughbores. Therefore, only one such set of three throughbores 106*a–c* will be described in detail.

The first throughbore 106*a* is registered with one of the adhesive passageways 66 and includes an opening 108 that overlays the adhesive inlet 74. A rigid conduit 110*a* is disposed within the throughbore 106*a*. The rigid conduit 110*a* has a threaded end 112*a* that is threadingly mated in fluid communication with the threaded length of the adhesive passageway 66 and another end 113*a* opposite to threaded end 112*a* that carries a fitting 114. The second throughbore 106*b* is registered with the actuation air passageway 68 and has an opening 116 that overlays the actuation air inlet 77. The third throughbore 106*c* is registered with the process air passageway 70 and has an opening 118 that overlays the process air inlet 79. Disposed within the throughbore 106*b* is a rigid conduit 110*b* which has one threaded end 112*b* that is threadingly mated in fluid communication with the threaded portion of the actuation air passageway 68 and another end 113*b* opposite to end 112*b* that carries a fitting 122. Disposed in throughbore 106*c* is a rigid conduit 110*c* which has one threaded end 112*c* that is threadingly mated in fluid communication with the threaded portion of the process air passageway 70 and another end 113*c* opposite to threaded end 112*c* that carries a fitting 126. As shown in FIG. 3, a set of three rigid conduits 110*d–f* similar to rigid conduits 110*a–c* is disposed in respective ones of throughbores 106*d–f*.

The throughbores 106*a–f* are oversized in at least one dimension relative to the dimensions of the respective ones of the rigid conduits 110*d–f*, as best shown in FIG. 5. In certain embodiments, the throughbores 106*a–f* are sized equal to or greater than the dimensions of the throughbores 102, taking dimensional differences between the respective ones of the rigid conduits 110*a–f* and fasteners 82 into consideration, so that the position of various ones of the movable plates 48 can be adjusted over a full range of movement bounded by the throughbores 102. It is understood that, for each of the dispensing modules 42, a set of three throughbores identical to throughbores 106*a–c* are provided in a respective one of the stationary plates 44 and that three rigid conduits identical to rigid conduits 110*a–c* are provided in respective ones of the throughbores. Rigid conduits 110*a–c* may be constructed of any structurally rigid material, such as a stainless steel, and have a construction including sidewall thickness sufficient to withstand the hydraulic pressure applied by the heated liquid.

One or more of the movable plates 48 may be translated relative to the stationary plates 44, when in the unfastened state, for varying the pattern of the hot melt adhesive dispensed by the dispensing modules 42. Moving any one of the movable plates 48 shifts the position of the dispensing modules 42 attached thereto relative to adjacent ones of the movable plates 48 and others of the dispensing modules 42 attached thereto. As a result, the spray of hot melt adhesive is shifted to strike a different location of the surface of the moving substrate 47 (FIG. 2). For example, the separation between adjacent movable plates 48 may be varied to change the width of the spray pattern of the dispensed hot melt adhesive so as to conform to a corresponding change in the width of the substrate 47 (FIG. 2). It is understood by those of ordinary skill in the art that either or both of the number of movable plates 48 and the number of stationary plates 44 may be varied according to the dispensing application for which the hot melt adhesive dispensing system 10 is designed.

As best shown in FIG. 3, the heated enclosure 50 encloses a heated space 128 surrounded by four side walls 130*a*, 130*b*, 132*a* and 132*b*, a top wall 134 and a bottom wall 136. The walls 130*a,b*, 132*a,b*, 134, and 136 may be formed in a conventional manner from, for example, a thin sheet of a metal, such as a stainless steel, and may be thermally insulated by applying a material having a low coefficient of thermal conductivity, such as a layer of a glass fiber insulation, to the interior surfaces thereof. Side wall 132*a* of the heated enclosure 50 includes a plurality of, for example, sixteen actuation air inlets 138, only some of which are shown in FIG. 3, which are each adapted with a fitting to fluidically couple with the actuation air source 61. The side wall 132*b* of the heated enclosure 50 includes a plurality of, for example, sixteen process air inlets 142, only some of which are shown in FIG. 3, which are each adapted with a fitting to fluidically couple with the process air source 55.

With reference to FIGS. 3 and 3A, the heated enclosure 50 contains a plurality of, for example, sixteen independent actuation air supply lines 146 and a plurality of, for example, sixteen independent process air supply lines 148. One of the actuation supply lines 146 and one of the process air lines 148 service one of the liquid dispensing modules 42. All of the actuation air supply lines 146 are identical, and therefore, only one such supply line 146 will be described in detail. One end of the actuation air supply line 146 has a fitting 150 adapted to fluidically connect an inlet of supply line 146 with one of the actuation air inlets 138. An opposite end of actuation air supply line 146 includes a fitting 152 adapted to fluidically connect an outlet of supply line 146 with the fitting 122 carried by rigid conduit 110*b*.

All of the process air supply lines 148 are identical, and therefore, only one such supply line 148 will be described in detail. One end of the process air supply line 148 has a fitting 154 adapted to fluidically connect an inlet of supply line 148 with fitting 126 installed in one of the process air inlets 142. An opposite end of the process air supply line 148 carries a fitting 156 adapted to fluidically connect an outlet of supply line 148 with the fitting 126 of rigid conduit 110*c*. It is understood that, in other embodiments, the actuation air supply lines 146 and/or the process air supply lines 148 may be routed to the liquid dispensing modules 42 in paths external of the heated enclosure 50. In such embodiments, one or both of the plurality of actuation air inlets 146 and/or process air inlets 148 may be omitted from the walls 132*a,b* of the heated enclosure 50. Fittings 122, 126, 150, 152,154, and 156 may be any pneumatic fluid fitting suitable for making fluid couplings.

The actuation air supply lines 146 and the process air supply lines 148 are flexible hoses or tubular conduits each formed from a thermally-conductive polymer which is mechanically stable at the temperature of the heated space 128 within heated enclosure 50. Suitable polymers include a line of fluropolymers, including polytetrafluoroethylene (PFTE), fluorinated ethylene propylene (FEP), perfluoroalkoxy copolymer (PFA), and amorphous fluoropolymers (AF), marketed under the trade name TEFLON® by E.I. du Pont de Nemours and Company (Wilmington, DE). The length of each actuation air supply line 146 and each process air supply line 148 is selected to accommodate the full range of motion of each movable plate 48 relative to the respective one of the stationary plates 44 to which the movable plate 48 is attached.

With continued reference to FIGS. 3 and 3A, a plurality of, for example, sixteen independent adhesive supply lines 158 are positioned within the heated space 128 of the heated enclosure 50. Each adhesive supply line 158 is adapted with a fitting 160 on one end suitable to connect to the fitting 114 of the rigid conduit 110*a* and a fitting 162 on the opposite end suitable to couple with one of the fittings 41 carried by one of the discharge outlets 38. This utilization of rigid conduits 110*a–c* in combination with throughbores 106*a–c* is necessary to ensure that the actuation air supply lines 146, process air supply lines 148 and adhesive supply lines 158 are in fluid continuity with respective ones of passageways 68, 70, and 66 irrespective of the placement of movable plates 48 with respect to stationary plate 44.

The adhesive supply lines 158 are formed of any flexible material or combination of materials that can sustain a flow of the hot melt adhesive. Adhesive supply lines 158 suitable for use with the present invention have a construction capable of withstanding the hydraulic pressure presented by the pressurized hot melt adhesive, typically in the range of about 300 p.s.i. to about 1200 p.s.i. The adhesive supply lines 158 must also be capable of withstanding the temperature of the hot melt adhesive and the temperature of the air within heated space 128 of the heated enclosure 50, typically in the range of about 200° F. and about 400° F., without experiencing significant structural or mechanical degradation. The material forming the adhesive supply lines 158 must be heat-transmissive so that heat energy can be transferred radially by thermal conduction through the sidewall for absorption by the hot melt adhesive contained therein. The adhesive supply lines 158 have lengths selected to accommodate the full range of motion of the movable plate 48 to which the liquid dispensing module 42 served by each adhesive supply line 158 is attached. The material forming the adhesive supply lines 158 must also have a flexibility that conforms to the movement of the movable plates 48 over the full range of motion.

The adhesive supply lines 158 are braided metal hose assemblies comprising an inner tubing of a thermally-conductive polymer surrounded by a braided cover of a metal, such as a stainless steel alloy. The polymer selected for the inner tubing is required to be chemically inert to hot melt adhesive and heat-resistant at temperatures for which the hot melt adhesive is molten, and at which the heated enclosure 50 is maintained, such that the mechanical and structural properties of the polymer do not significantly degrade. Suitable polymers for forming the inner tubing of the adhesive supply lines 158 include thermoplastic fluorocarbon resins such as fluorinated ethylene propylene, polytetrafluoroethylene, perfluoroalkoxy copolymer, and amorphous fluoropolymers. Suitable braided metal hose assemblies utilizing an inner tubing of polytetrafluoroethylene and a stainless steel braided cover are commercially available, for example, from McMaster-Carr Supply Company (Chicago, Ill.). Fittings 41, 114, 160 and 162 may be any hydraulic fitting suitable for making fluid couplings.

With reference to FIG. 3, a heating element 164, such as an electrical resistance heating element, is positioned within the heated space 128 of the heated enclosure 50 and is electrically connected to a temperature controller/power supply 166. Heat energy from the heating element 164 is transferred within the heated space 128 to the adhesive supply lines 158 at a rate which maintains the hot melt adhesive flowing through the adhesive supply lines 158 in a molten, flowable state. Suitable electrical resistance heating elements 42 are commercially available from, for example, Watlow Electric Manufacturing Company, St. Louis, Mo. Common hot melt adhesives used in adhesive dispensing operations are thermoplastic polymers that are sufficiently flowable for dispensing at a predetermined temperature ranging between about 200° F. and about 400° F. Therefore, for common hot melt adhesives, sufficient heat energy would have to be transferred from the heating element 164 to the adhesive supply lines 158 effective to maintain the predetermined temperature between about 200° F. and about 400° F.

With continued reference to FIG. 3, the bottom wall 136 of the heated enclosure 50 includes a plurality of, for example, sixteen apertures 167 located so as to register with respective ones of the throughbores 106*a–c* in the stationary plate 44. Each aperture 166 is dimensioned similar to the respective one of the throughbores 106*a–c* in the stationary plates 44. One of the adhesive supply lines 158, the actuation air supply lines 146 and the process air supply lines 148 extend through the registered pairs of the throughbores 106*a–c* and apertures 167.

With reference to FIGS. 3 and 3A, the movable plates 48 are repositionable, when in the unfastened state, with respect to the stationary plates 44 in a first direction into and out of the plane of the page when viewing FIG. 3A. The repositioning alters the longitudinal separation between adjacent ones of the movable plates 48 and, therefore, alters the longitudinal spacing between the respective sprays 45 (FIG. 2) of hot melt adhesive from the liquid dispensing modules 42 attached thereto to thereby alter the spray pattern dispensed by the bank of modules 42. The substrate 47 (FIG. 2) receiving the hot melt adhesive is traveling in a second direction 170 (FIG. 3) generally orthogonal to the first direction in which the movable plates 48 are repositionable.

When one of the movable plates 48 is in the unfastened state, the range of motion of that particular movable plate 48 is constrained by the movement of the rigid conduits 110*a–c* in the registered pairs of throughbores 106*a–c* in the stationary plates 44 and apertures 167 in the heated enclosure 50. With reference to FIGS. 3A and 5, throughbores 106*a–c* are slotted and elongated in a first direction generally perpendicular into and out of the plane of the page when viewing FIG. 3. Apertures 167 are slotted and elongated similar to throughbores 106*a–c*. As best shown in FIG. 5, the throughbores 106*a–c*, as well as apertures 167, have a geometrical cross-sectional profile with a transverse dimension in a second direction orthogonal to the first direction that is greater than the outer diameter of the associated one of the rigid conduits 110*a–c* and a longitudinal dimension that defines the range of motion for the movable plate 48 relative to the stationary plate 44.

The throughbores 102 are likewise oversized relative to the diameter of the shank 85 of threaded fasteners 82. Generally, throughbores 102 are sized relative to fasteners 82 such that the movement of the rigid conduits 110*a–c* in the registered pairs of throughbores 106*a–c* and apertures 167 determines the range of motion. However, the present invention is not so limited. In the embodiment of the present invention shown in FIG. 3A, the throughbores 102 are slotted or elongated longitudinally so that the movable plate 48 may only move in the first direction relative to the stationary plate. Alternatively, the throughbores 102 may be oversized relative to the diameter of the shank 85 in the second direction 170 (FIG. 3) as well so that the movable plate 48 is movable in a two-dimensional plane.

It is understood by those of ordinary skill in the art that liquid dispensing systems 10 can allow for the recirculation of the hot melt adhesive from unused liquid dispensing modules 42 or blocked-off dispensing locations. In such systems 10, the hot melt adhesive is recirculated by providing, among other things, recirculation supply lines similar to liquid supply lines 158 that interconnect recirculation passageways in the modules 42 with inlets provided in the manifold 26 that return the hot melt adhesive to the manifold 26 so that it can be rerouted by the metering gear head 12 in metered quantities to the discharge outlets 38 or can be returned to the adhesive source 30.

In use, the movable plates 48 are positioned in a fastened state with respect to the stationary plates 44 so that the liquid dispensing modules 42 dispense a pattern of a hot melt adhesive onto the substrate 47 (FIG. 2) moving in a path that intersects the dispensed pattern. In the portion of the fluid path from the adhesive source 30 to the liquid dispensing modules 42 located within the heated enclosure 50, the hot melt adhesive is maintained in a molten state by heat transferred from the heating element 164 to the flexible adhesive supply lines 158. The pattern of the dispensed hot melt adhesive is changed by loosening the fastening devices 104 from the threaded fasteners 80 securing one or more movable plates 48 to provide the unfastened state and repositioning each movable plate 48 that is in the unfastened state to a different position. After repositioning, the fastening devices 104 are tightened on threaded fasteners 80 to reestablish a fastened state. The repositioning of each movable plate 48 repositions any attached liquid dispensing modules 42 so that the hot melt adhesive dispensed thereby will strike the moving substrate 47 (FIG. 2) at a different location so as to alter the pattern of the dispensed adhesive. Each flexible adhesive supply line 158 flexes to accommodate the movement of the movable plate 48 relative to the stationary plate 44.

Figure 4:
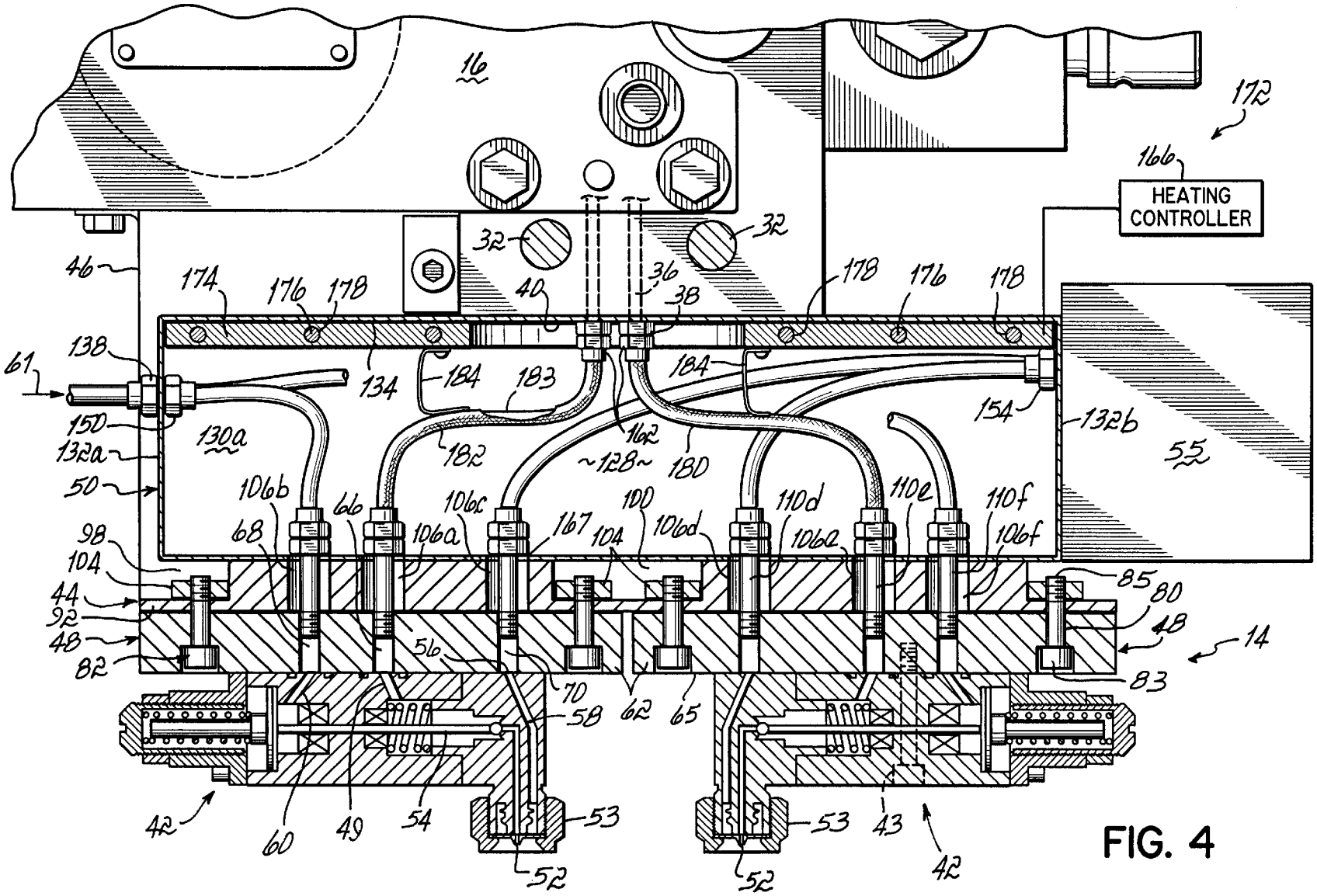
FIG. 4 is a front elevational view with partial cutaway of an alternative embodiment of the hot melt adhesive dispensing system of FIG. 1.

With reference to FIG. 4 in which like reference numbers refer to like elements in FIG. 3, an embodiment of a liquid dispensing system 172 of the present invention includes a heated metal plate 174 within the heated enclosure 50. Heat energy is provided to the metal plate 174 by one or more conventional cartridge heaters 176 that are positioned within a corresponding number of longitudinal blind bores 178 provided within the metal plate 174. Cartridge heaters 176 suitable for use in this embodiment of the present invention are commercially available, for example, from McMaster-Carr Supply Company (Chicago, Ill.).

With continued reference to FIG. 4, liquid dispensing system 172 is provided with a plurality of adhesive supply lines 180, similar to adhesive supply lines 158 (FIGS. 1–3 and 3A). Each adhesive supply line 180 has a braided metal outer cover 182 and an inner tubing 183 surrounded by outer cover 182. The inner tubing 183 confines the flowing hot melt adhesive and the outer cover 182 is thermally coupled with the heated metal plate 174 by respective ones of a plurality of heat transfer elements 184. The heat transfer elements 184 are formed of a material having a high thermal conductivity, such as lengths of a braided metal. One end of each heat transfer element 184 is attached to the metal plate 174 by a conventional fastening technique that promotes a good thermal contact. Similarly, an opposite end of each heat transfer element 184 is attached to the braided metal outer cover 182 of one of the adhesive supply lines 182 by a conventional fastening technique that likewise promotes a good thermal contact.

Heat energy is conducted from the heated metal plate 174 along the length of each heat transfer element 184 to the outer cover 182 of one of the adhesive supply lines 180. The heat energy is conducted along the length of the adhesive supply lines 180 and radially through the side walls of the outer cover 182 and the inner tubing 183, where the heat energy is absorbed by successive volumes of the hot melt adhesive flowing therethrough. The configuration and dimensions, including length and cross-sectional area, of the heat transfer elements 184 are selected to transfer an amount of heat energy effective to maintain the temperature of the hot melt adhesive flowing through each adhesive supply line 180 at or near the selected temperature.

The present invention provides apparatus for attaching multiple liquid dispensing modules to a flow metering device such that each of the liquid dispensing modules can be easily and quickly moved to alter the pattern of dispensed liquid from one predetermined pattern to a different predetermined pattern. This is accomplished by mounting the individual liquid dispensing modules to movable plates that are movable relative to a supporting stationary plate. The movable plates permit the relative positions of liquid dispensing gun modules to be quickly and easily adjusted to alter the relative spacings therebetween. Further, the apparatus of the present invention includes flexible liquid supply lines that flex to allow the movable plates to move relative to the stationary plate. The combination of features eliminates the necessity of a custom liquid distribution manifold between the flow metering device and the liquid dispensing modules. As a result, a liquid dispensing system constructed according to the present invention can quickly and simply provide a means to adjust the pattern of dispensed liquid. For those dispensed liquids that are heated above an ambient temperature, the apparatus of the present invention further provides a heated enclosure in the travel path of the heated liquid between the flow metering device and the liquid dispensing modules and at least a portion of the liquid supply lines are routed through the heated enclosure to maintain the heated liquid at a desired temperature. The apparatus of the present invention is free of dynamic seals and sliding sealing surfaces otherwise needed in conventional liquid dispensing systems with adjustable-position liquid dispensing modules to fluidically couple the modules with a flow metering device.

While the present invention has been illustrated by a description of various preferred embodiments and while these embodiments have been described in considerable detail in order to describe the best mode of practicing the invention, it is not the intention of applicant to restrict or in any way limit the scope of the appended claims to such detail. Additional advantages and modifications within the spirit and scope of the invention will readily appear to those skilled in the art.

The invention itself should only be defined by the appended claims, wherein I claim:

1. An apparatus for dispensing a liquid comprising:

a flow metering device having a liquid discharge port operable to discharge metered quantities of the liquid;

a stationary plate mounted to said flow metering device, said stationary plate including a first throughbore extending therethrough;

a movable plate mounted for sliding movement relative to said stationary plate, said movable plate including a liquid passageway having an inlet and an outlet;

a liquid dispensing module attached to said movable plate, said liquid dispensing module fluidically coupled with said outlet of said liquid passageway; and a liquid supply line having a first end fluidically coupled with said liquid discharge port and a second end extending through said first throughbore to fluidically couple with said inlet of said liquid passageway, said liquid supply line having a flexible first portion that permits said liquid discharge port and said inlet of said liquid passageway to remain fluidically coupled when said movable plate is slidingly moved relative to said stationary plate.

2. The apparatus of claim 1, further comprising a heated enclosure providing a heated space between said liquid discharge port and said first throughbore, said heated enclosure having a first aperture registered with said first throughbore, and said liquid supply line extending through said registered first aperture and said first throughbore.

3. The apparatus of claim 2, wherein said flexible portion of said liquid supply line is at least partially disposed within said heated space.

4. The apparatus of claim 2, wherein said flexible first portion further comprises an inner tubing and an outer cover encasing said inner tubing, said inner tubing formed of a thermally-conductive polymer that is thermally stable at the temperature within said heated enclosure and said outer cover formed of a material that is rupture resistant and thermally conductive.

5. The apparatus of claim 4, wherein said polymer is a thermoplastic fluorocarbon resin.

6. The apparatus of claim 5, wherein said thermoplastic fluorocarbon resin is selected from the group consisting of fluorinated ethylene propylenes, polytetrafluoroethylenes, perfluoroalkoxy copolymers, and amorphous fluoropolymers.

7. The apparatus of claim 2, wherein said heated enclosure includes a heating element operable to transfer heat energy to said liquid supply line.

8. The apparatus of claim 7, further comprising a heat transfer element and wherein said flexible first portion of said liquid supply line includes a thermally-conductive inner tubing and a thermally-conductive outer cover encasing said inner tubing, said outer cover thermally coupled to said heating element by said heat transfer element such that heat energy is conducted by said heat transfer element from said heating element to said outer cover and from said outer cover radially for absorption by the liquid.

9. The apparatus of claim 1, wherein said liquid supply line further comprises a rigid second portion extending through said first throughbore to fluidically couple with said liquid passageway.

10. The apparatus of claim 9, wherein the movement of said second portion of said liquid supply line within said first throughbore determines the range of motion of said movable plate.

11. The apparatus of claim 1, wherein said stationary plate further includes a second throughbore extending therethrough, said movable plate includes a fluid passageway having an inlet and an outlet, said liquid dispensing module is fluidically coupled with said outlet of said fluid passageway, and a fluid supply line having a first end fluidically coupled with a fluid source and a second end extending through said second throughbore to fluidically couple with said inlet of said fluid passageway, said fluid supply line having a flexible first portion that permits said inlet of said fluid passageway to remain fluidically coupled with the fluid source when said movable plate is slidingly moved relative to said stationary plate.

12. The apparatus of claim 11, wherein said liquid dispensing module includes an electropneumatically-actuated valve for regulating a flow of the liquid through said module and said fluid passageway conveys pressurized actuation air from the fluid source to said liquid dispensing module for actuating said pneumatically-actuated valve.

13. The apparatus of claim 11, wherein said fluid passageway provides pressurized process air to said liquid dispensing module from said fluid source and said liquid dispensing module utilizes the process air to manipulate a property of the liquid dispensed by said liquid dispensing module.

14. The apparatus of claim 11, wherein said fluid supply line further comprises a rigid second portion extending through said second throughbore to fluidically couple with said fluid passageway in said movable plate.

15. The apparatus of claim 14, wherein the movement of said second portion of said fluid supply line within said second throughbore delimits a range of motion of said movable plate.

16. An apparatus for dispensing a liquid comprising:

a flow metering device having a plurality of liquid discharge ports each operable to discharge metered quantities of the liquid;

a stationary plate mounted to said flow metering device, said stationary plate including an array of first throughbores extending therethrough;

a plurality of movable plates each mounted for sliding movement relative to said stationary plate, each of said plurality of movable plates including at least one liquid passageway having an inlet and an outlet;

a plurality of liquid dispensing modules each attached to one of said movable plates, each of said plurality of liquid dispensing modules fluidically coupled with said outlet of said at least one liquid passageway; and a plurality of liquid supply lines each having a first end fluidically coupled with one of said plurality of liquid discharge ports and a second end extending through one of said first throughbores to fluidically couple with said inlet of one of said liquid passageways, each of said liquid supply lines having a flexible first portion that permits said liquid discharge port and said inlet of said liquid passageway to remain fluidically coupled when respective ones of said movable plates are slidingly moved relative to said stationary plate.

17. The apparatus of claim 16, further comprising a heated enclosure providing a heated space between said plurality of liquid discharge ports and said array of first throughbores, said heated enclosure having a plurality of first apertures each registered with one of said array of first throughbores, and each of said plurality of liquid supply lines extending through one of said registered first apertures and first throughbores.

18. The apparatus of claim 17, wherein said flexible portion of each of said plurality of liquid supply lines is at least partially disposed within said heated space.

19. The apparatus of claim 17, wherein said flexible first portion further comprises an inner tubing and an outer cover encasing said inner tubing, said inner tubing formed of a thermally-conductive polymer that is thermally stable at the temperature within said heated enclosure and said outer cover formed of a material that is rupture resistant and thermally conductive.

20. The apparatus of claim 19, wherein said polymer is a thermoplastic fluorocarbon resin.

21. The apparatus of claim 20, wherein said thermoplastic fluorocarbon resin is selected from the group consisting of fluorinated ethylene propylenes, polytetrafluoroethylenes, perfluoroalkoxy copolymers, and amorphous fluoropolymers.

22. The apparatus of claim 17, wherein said heated enclosure includes a heating element operable to transfer heat energy to said liquid supply line.

23. The apparatus of claim 22, further comprising a plurality of heat transfer elements and wherein said flexible first portion of each of said plurality of liquid supply lines includes an inner tubing and a thermally-conductive encasing said inner tubing, said outer cover thermally coupled to said heating element by one of said plurality of heat transfer elements such that heat energy is conducted by said heat transfer element from said heating element to said outer cover.

24. The apparatus of claim 17, wherein each of said plurality of liquid supply lines further comprises a rigid second portion extending through one of said first throughbores to fluidically couple with one of said liquid passageways.

25. The apparatus of claim 24, wherein the movement of said second portion of each of said plurality of liquid supply lines within said first throughbore determines the range of motion of said movable plate.

26. The apparatus of claim 17, wherein said stationary plate further includes a plurality of second throughbores extending therethrough, said movable plate includes a plurality of fluid passageways each having an inlet and an outlet, each of said plurality of liquid dispensing modules is fluidically coupled with said outlet of one of said fluid passageways, and a plurality of fluid supply lines each having a first end fluidically coupled with a fluid source and a second end extending through one of said second throughbores to fluidically couple with said inlet of one of said fluid passageways, each of said plurality of fluid supply lines having a flexible first portion that permits said inlet of said fluid passageway to remain fluidically coupled with the fluid source when said movable plate is slidingly moved relative to said stationary plate.

27. The apparatus of claim 26, wherein each of said plurality of liquid dispensing modules includes an electropneumatically-actuated valve for regulating a flow of the liquid through said module and said fluid passageway conveys pressurized actuation air from the fluid source to said liquid dispensing modules for actuating said pneumatically-actuated valve.

28. The apparatus of claim 26, wherein said fluid passageway provides pressurized process air to said liquid dispensing module from said fluid source and said liquid dispensing module utilizes the process air to manipulate a property of the liquid dispensed by said liquid dispensing module.

29. The apparatus of claim 26, wherein each of said plurality of fluid supply lines further comprises a rigid second portion extending through said second throughbore to fluidically couple with said fluid passageway in said movable plate.

30. The apparatus of claim 29, wherein the movement of said second portion of each of said plurality of fluid supply lines within one of said plurality of second throughbores delimits a range of motion of at least one of said plurality of movable plates.

* * * * *